US010259609B2

(12) United States Patent
Kuhar et al.

(10) Patent No.: US 10,259,609 B2
(45) Date of Patent: Apr. 16, 2019

(54) CONTAINER AND METHOD OF MANUFACTURE

(71) Applicant: Ring Container Technologies, LLC, Oakland, TN (US)

(72) Inventors: Eugene Kuhar, Lakeland, TN (US); Kevin Gaydosh, Adrian, MI (US)

(73) Assignee: RING CONTAINER TECHNOLOGIES, LLC, Oakland, TN (US)

( * ) Notice: Subject to any disclaimer, the term of this patent is extended or adjusted under 35 U.S.C. 154(b) by 0 days.

(21) Appl. No.: 15/371,979

(22) Filed: Dec. 7, 2016

(65) Prior Publication Data

US 2017/0158370 A1 Jun. 8, 2017

Related U.S. Application Data

(60) Provisional application No. 62/264,656, filed on Dec. 8, 2015.

(51) Int. Cl.
*B65D 1/02* (2006.01)
*B65D 23/10* (2006.01)
(Continued)

(52) U.S. Cl.
CPC ..... *B65D 1/0207* (2013.01); *B65D 1/0223* (2013.01); *B65D 1/0246* (2013.01);
(Continued)

(58) Field of Classification Search
CPC .. B65D 1/0207; B65D 1/0223; B65D 1/0246; B65D 1/0261; B65D 1/44; B65D 1/42;
(Continued)

(56) References Cited

U.S. PATENT DOCUMENTS 3,152,710 A * 10/1964 Platte ..... B65D 1/0223 215/384
3,366,290 A * 1/1968 Mojonnier ..... B29C 49/4802 215/382
(Continued)

FOREIGN PATENT DOCUMENTS

CA 2670889 12/2010
CA 2670889 A1 12/2010
(Continued)

OTHER PUBLICATIONS

International Search Report and Written Opinion of the International Searching Authority (ISA/EPO) dated Feb. 27, 2017 of International (PCT) Application No. PCT/US2016/065370 filed on Dec. 7, 2016, entire document.
(Continued)

*Primary Examiner* — Robert J Hicks
(74) *Attorney, Agent, or Firm* — Sorell, Lenna & Schmidt, LLP

(57) ABSTRACT

A container is provided that includes a top portion, a bottom portion and a plurality of sidewalls that each extend from an upper limit of the bottom portion, the top portion extending from upper limits of each of the side walls such that the sidewalls are positioned between the top portion and the bottom portion. The container comprises a plurality of indents therein, the indents being arranged in a configuration to avoid top load failure. That is, the indents provide strength to the container, which makes the container stronger than containers that are made from the same material, have the same weight and the same average wall thickness, but do not include indents.

25 Claims, 16 Drawing Sheets

(51) Int. Cl.
*B65D 25/42* (2006.01)
*B65D 1/44* (2006.01)

(52) U.S. Cl.
CPC ..... *B65D 1/0261* (2013.01); *B65D 1/0276* (2013.01); *B65D 1/0284* (2013.01); *B65D 1/44* (2013.01); *B65D 23/10* (2013.01); *B65D 25/42* (2013.01); *B65D 2501/0027* (2013.01)

(58) Field of Classification Search
CPC ..... B65D 1/40; B65D 23/10; B65D 25/42; B65D 25/40; B65D 11/24; B65D 11/22; B65D 11/20
USPC ..... 215/382, 381, 379, 44; 220/675, 674, 220/669
See application file for complete search history.

(56) References Cited

U.S. PATENT DOCUMENTS

| | | | | | |
|---|---|---|---|---|---|
| 3,434,635 | A * | 3/1969 | Mason, Jr. | B65D 1/0223 | 215/398 |
| 4,308,955 | A * | 1/1982 | Schieser | B65D 1/0223 | 206/509 |
| 4,313,545 | A * | 2/1982 | Maeda | B65D 7/04 | 220/4.04 |
| D322,562 | S * | 12/1991 | Narsutis | D9/538 | |
| 5,224,614 | A * | 7/1993 | Bono | B65D 23/102 | 215/384 |
| 5,341,946 | A * | 8/1994 | Vailliencourt | B65D 1/0223 | 215/381 |
| 5,392,937 | A * | 2/1995 | Prevot | B65D 1/0223 | 215/396 |
| 5,908,127 | A * | 6/1999 | Weick | B65D 1/0223 | 215/373 |
| D427,077 | S * | 6/2000 | Heliste | D9/543 | |
| D504,069 | S * | 4/2005 | Gross | D9/538 | |
| D527,272 | S * | 8/2006 | Lovelace, Jr. | D9/541 | |
| 8,479,420 | B2 * | 7/2013 | Moretti | B65D 1/0223 | 215/381 |
| 9,896,233 | B2 * | 2/2018 | Denner | B65D 1/0223 | |
| 2007/0012650 | A1 * | 1/2007 | Eble | B65D 1/0223 | 215/382 |
| 2007/0187355 | A1 | 8/2007 | Kamineni | | |
| 2008/0017604 | A1 | 1/2008 | Livingston et al. | | |
| 2008/0173613 | A1 * | 7/2008 | Ross | B65D 1/0223 | 215/379 |
| 2010/0084360 | A1 | 4/2010 | Dornbach | | |
| 2011/0132863 | A1 | 6/2011 | Dorn | | |
| 2013/0026128 | A1 * | 1/2013 | Beck | B65D 1/44 | 215/382 |
| 2013/0200037 | A1 * | 8/2013 | Yourist | B65D 23/102 | 215/382 |

FOREIGN PATENT DOCUMENTS

| | | |
|---|---|---|
| WO | 9833712 | 8/1998 |
| WO | 9833712 A1 | 8/1998 |

OTHER PUBLICATIONS

PCT/US2016/065370 Written Opinion of the International Searching Authority, dated Jun. 21, 2018, ISA—European Patent Office.
European Patent Application No. 16 816143.8, Examination Report issued by European Patent Office (EPO) dated Oct. 16, 2018, European Patent Office, The Hague, Patentlaan 2, 2288 EE Rijswijk, Netherlands.

* cited by examiner

CONTAINER AND METHOD OF MANUFACTURE

CROSS REFERENCE TO RELATED APPLICATION

This application claims the benefit of the filing date of U.S. Provisional Application No. 62/264,656, filed on Dec. 8, 2015, the contents of which being hereby incorporated by reference herein in its entirety.

TECHNICAL FIELD

The present disclosure generally relates to containers, and in particular, a High Density Polyethylene (HDPE) container having a reduced weight without compromising strength and/or performance.

BACKGROUND

Plastic blow-molded containers are commonly used for food packaging products. Many food and beverage products are sold to the consuming public in wide mouth jar-like blow-molded containers. These containers can be made from polyethylene terephthalate or other suitable plastic resins in a range of sizes. The empty blow-molded containers can be filled with food and/or beverage products at a fill site utilizing automated fill equipment.

For example, manufacture of such plastic blow-molded containers can include initially forming plastic resin into a preform, which may be provided by injection molding. Typically, the preform includes a mouth and a generally tubular body that terminates in a closed end. Prior to being formed into containers, preforms are softened and transferred into a mold cavity configured in the shape of a selected container. In the mold cavity, the preforms are blow-molded or stretch blow-molded and expanded into the selected container.

Such plastic blow-molded containers may be produced on single stage injection mold equipment. The single stage blow molding process combines the injection molding of the preform and blowing of the container into one machine. This machine has an extruder that melts resin pellets and injects the molten resin into a mold to create the preform. The preform is transferred to a blow station to form the container and removed from the machine. In some cases, the plastic blow-molded containers are produced with two-stage equipment. The two-stage equipment makes preforms in an injection molding machine and then reheats and blows the preforms into selected containers in a separate blowing machine.

One consideration in making containers, such as, for example, containers made from HDPE, is reducing the amount of material used since the amount of materials used is directly related to the cost of the container. That is, the less material used, the less the container costs to make.

Typically, a one gallon HDPE container uses about 110 grams of HDPE. These containers have an average wall thickness of about 0.0285 inches. Prior attempts have been made to reduce the amount of materials used by decreasing and/or reducing the wall thickness of such containers. However, decreasing and/or reducing the wall thickness of containers often results in a loss of strength and/or performance. For example, decreasing and/or reducing the wall thickness of containers often results in a logarithmic deterioration in top load. This disclosure includes an improvement over such prior art technologies.

SUMMARY

In one embodiment, in accordance with the principles of the present disclosure, a HDPE container is provided that has a reduced average wall thickness. In some embodiments, the average wall thickness is about 0.018 inches. In some embodiments, the container is made from HDPE, wherein the HDPE has a yield stress of 4,000 psi, an overall stress of 6,000 psi, an elastic modulus of 200,000 psi and a Poisson's ratio of 0.33. In some embodiments, the container is made from about 70 grams to about 80 grams of HDPE. In some embodiments, the wall distribution is optimized to provide the containers with sufficient top load performance to avoid top load failure.

In some embodiments, the container includes a top portion, a bottom portion and a plurality of sidewalls that each extends from an upper limit of the bottom portion, the top portion extending from upper limits of each of the side walls such that the sidewalls are positioned between the top portion and the bottom portion. The container comprises a plurality of indents therein. In some embodiments, the indents each have a rectangular configuration. In some embodiments, the indents each have an oblong configuration. In some embodiments, the indents are arranged in a configuration to provide strength to the container that makes the container stronger than containers that are made from the same material and have the same weight and the same average wall thickness, but do not include indents. In some embodiments, the configuration includes a plurality of spaced apart columns of the indents, each of the columns comprising at least two of the indents that are spaced apart from one another such that the body portion includes at least two rows of the indents. In some embodiments, adjacent columns of the indents each form a rib therebetween. In some embodiments, the indent(s) in each of the columns is/are coaxial with the indent(s) in the same column. In some embodiments, the indent(s) in each of the columns is/are aligned along a straight line with the indent(s) in the same column. In some embodiments, a first row of the indents extends across in a first arcuate section of the body portion and a second row of the indents extends across a second arcuate section of the body portion. In some embodiments, the first arcuate portion is convexly curved and the second arcuate portion is concavely curved.

In some embodiments, the container has a thin wall construction. In some embodiments, the container has an average wall thickness of about 0.018 inches. In some embodiments, the container has a weight of 70 to 80 grams and a volume of 128 ounces. In some embodiments, the container has a weight of 75 grams and a volume of 128 ounces. In some embodiments, the container has a weight of 80 grams and a volume of 128 ounces. In some embodiments, the container is made from HDPE. In some embodiments, the container is a blow-molded container. In some embodiments, the plurality of sidewalls comprises eight sidewalls. In some embodiments, the top portion includes a body portion having a spout with an opening by which material may be introduced into the interior of the container. In some embodiments, the body portion defines a shoulder portion of the container. In some embodiments, the container includes a handle which is hollow and permits liquid and air to pass inside it. In some embodiments, the handle extends from one of the sidewalls to a spout in the top portion. In some embodiments, the handle is positioned such that when the container is held for pouring, a center of mass is concentrated along an axis which intersects both the handle the sidewall the handle extends from. In some embodiments, a first end of the handle directly engages a portion of the spout and a second end of the handle directly engages a portion of the sidewall the handle extends from.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

Figure 1:
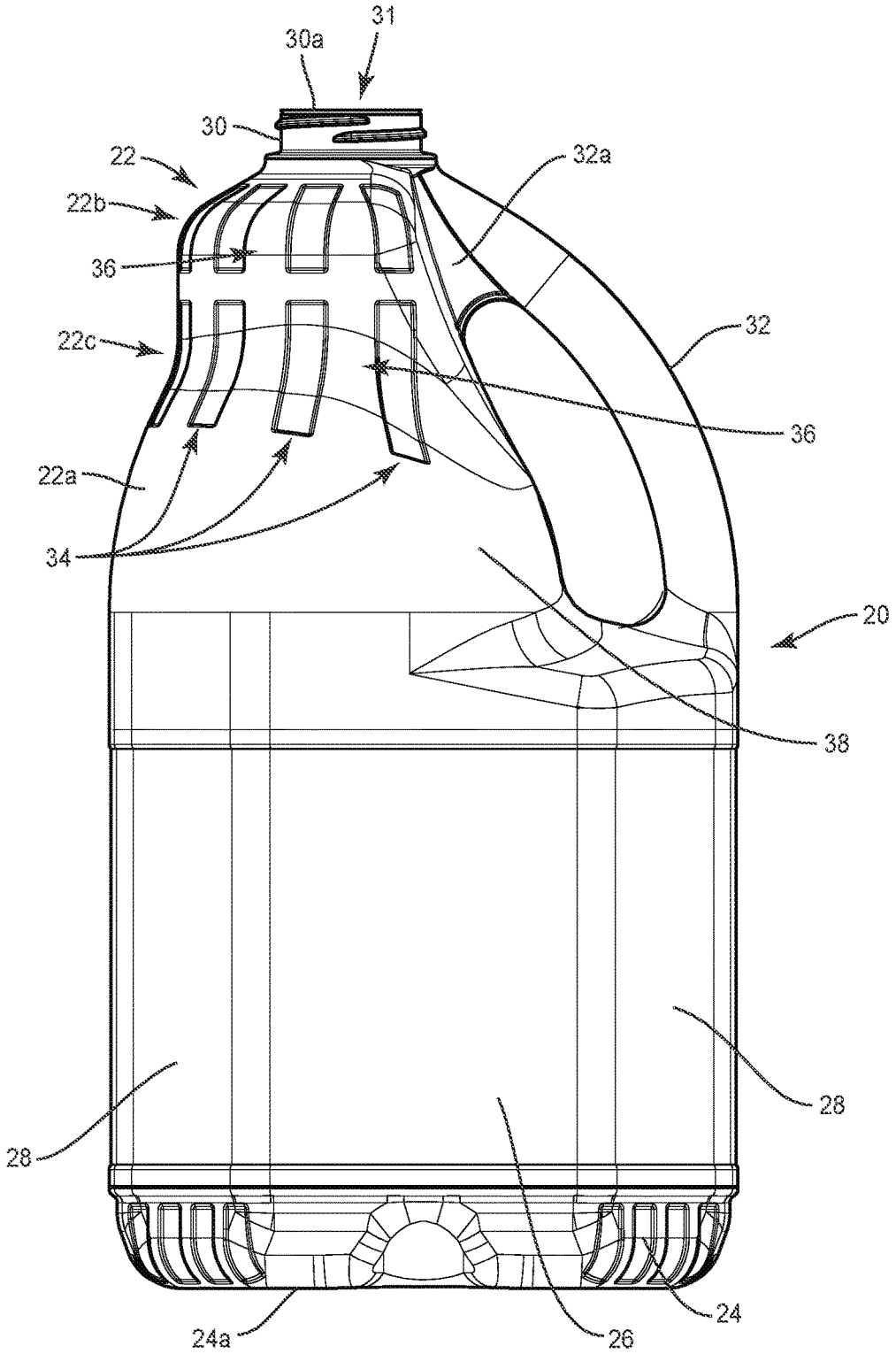
FIG. 1 is a side view of one embodiments of a container in accordance with the principles of the present disclosure.

The exemplary embodiments of an HDPE container are discussed in terms of containers having a reduced weight and optimized wall distribution that avoids compromising strength and/or performance due to the reduced weight. The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of an HDPE container having a reduced average wall thickness and optimized wall distribution to provide the container with sufficient top load performance to avoid top load failure. In some embodiments, the present container can be filled with food, food preparation oils, viscous and/or beverage products. In some embodiments, the present container can be employed as a cold fill container. In some embodiments, the present container can be employed as a hot fill container. In some embodiments, the present container is employed as a light weight, high strength and barrier food packaging product.

In some embodiments, the present container is manufactured with selective physical performance features, such as, for example, a reduction in plastic weight, a selected preform design, selected bottle processing and/or bottle crystallinity of side walls of a blown container. In some embodiments, the selected physical performance features can include a higher injection molding efficiency and/or cavitation and an increased bi-axial orientation of PET container material. In some embodiments, the present container is manufactured with a smaller diameter preform, which forms a final bottle neck finish through the blowing process that allows for higher injection mold efficiency as well as improved material orientation throughout the container. In some embodiments, the container includes an improved material distribution and crystalline orientation. In some embodiments, this manufacturing method provides a container having improved top load, vacuum resistance and/or permeability. In some embodiments, this manufacturing method provides stretching PET to optimum crystalline orientation levels to improve physical performance in top load, vacuum, gas and vapor permeation through the container side walls. Reference will now be made in detail to the exemplary embodiments of the present disclosure, which are illustrated in the accompanying figures. Turning to FIGS. 1-16, there are illustrated components of a container 20.

Container 20 is made from a polymer, such as, for example, a thermoplastic. In some embodiments the thermoplastic is HDPE, wherein the HDPE has a yield stress between 2,000 psi and 6,000 psi, an overall stress between 2,000 psi and 6,000 psi, an elastic modulus between 100,000 psi and 300,000 psi and a Poisson's ratio of between 0.25 and 0.50. In some embodiments, the HDPE has a yield stress of 4,000 psi, an overall stress of 6,000 psi, an elastic modulus of 200,000 psi and a Poisson's ratio of 0.33. In some embodiments, container 20 is made from 60-90 grams of HDPE. In some embodiments, container 20 is made from 70-80 grams of HDPE. It is envisioned that container 20 may be made from other such materials as synthetic polymers, including thermoplastics, semi-rigid and rigid materials, elastomers, fabric and/or their composites.

Figure 4:
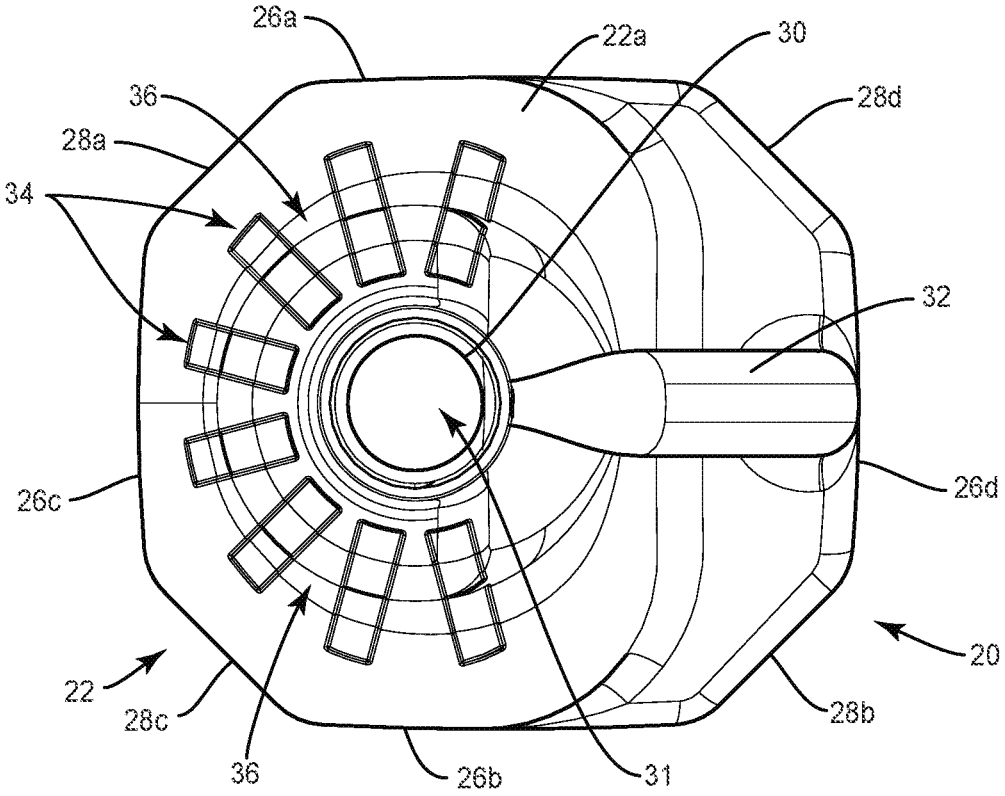
FIG. 4 is a top view of the container shown in FIG. 1.
Figure 5:
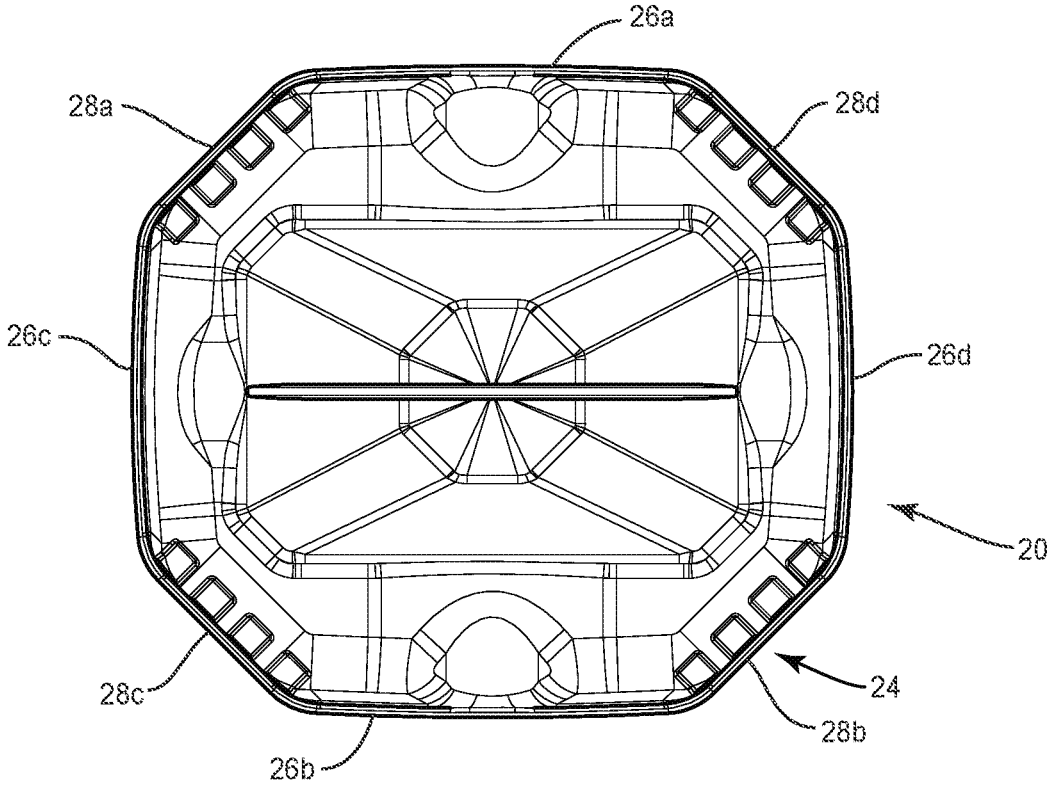
FIG. 5 is a bottom view of the container shown in FIG. 1.
Figure 6:
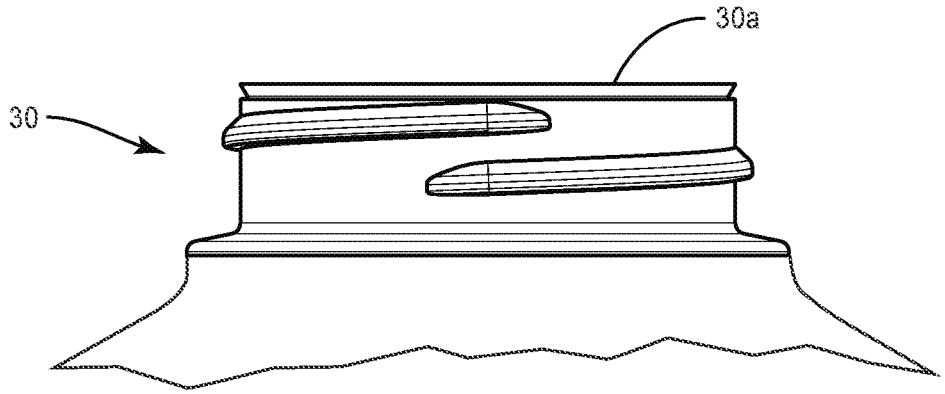
FIG. 6 is a detailed side view of a portion of the container shown in FIG. 1.
Figure 7:
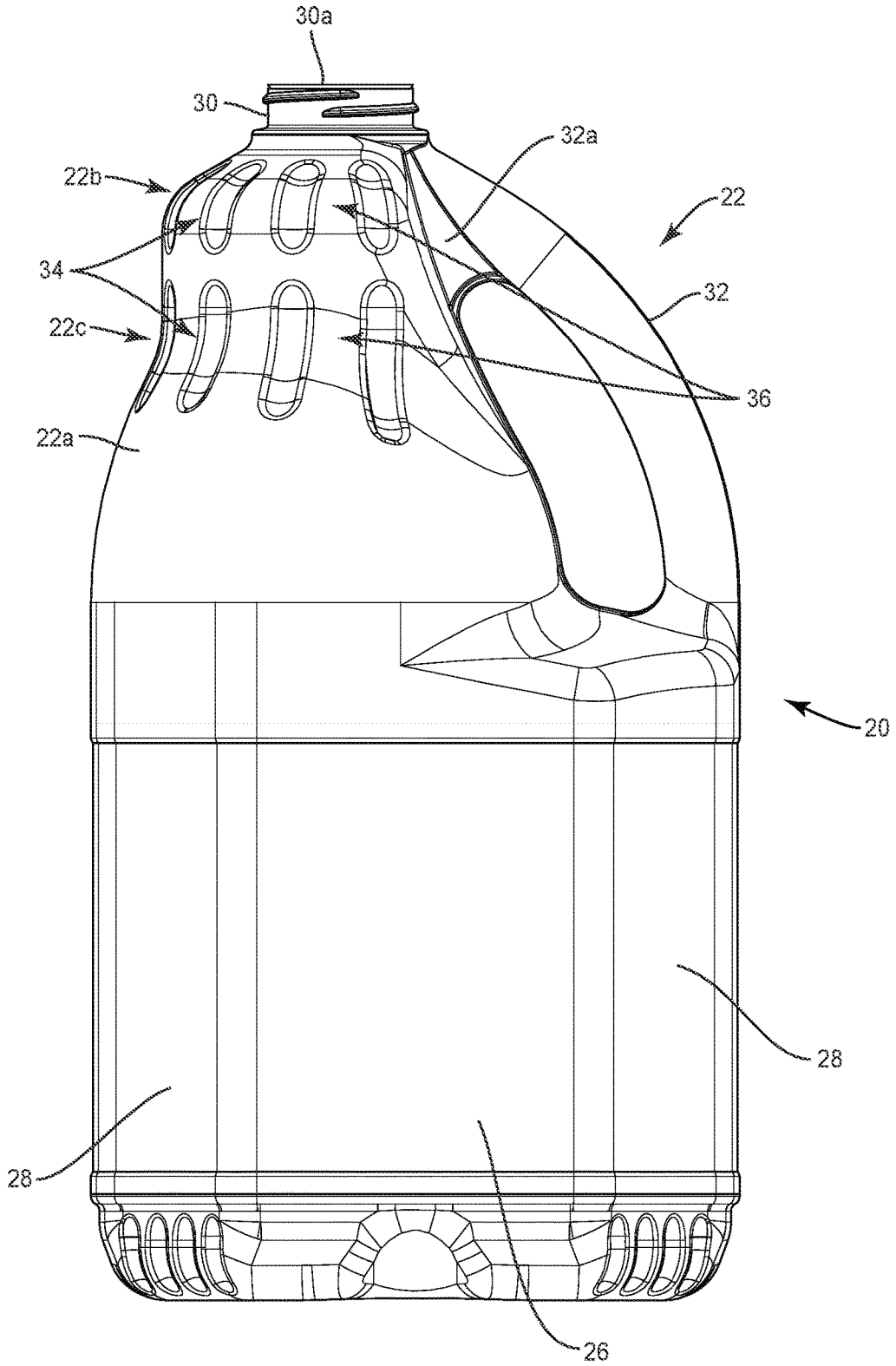
FIG. 7 is a side view of one embodiments of a container in accordance with the principles of the present disclosure.
Figure 8:
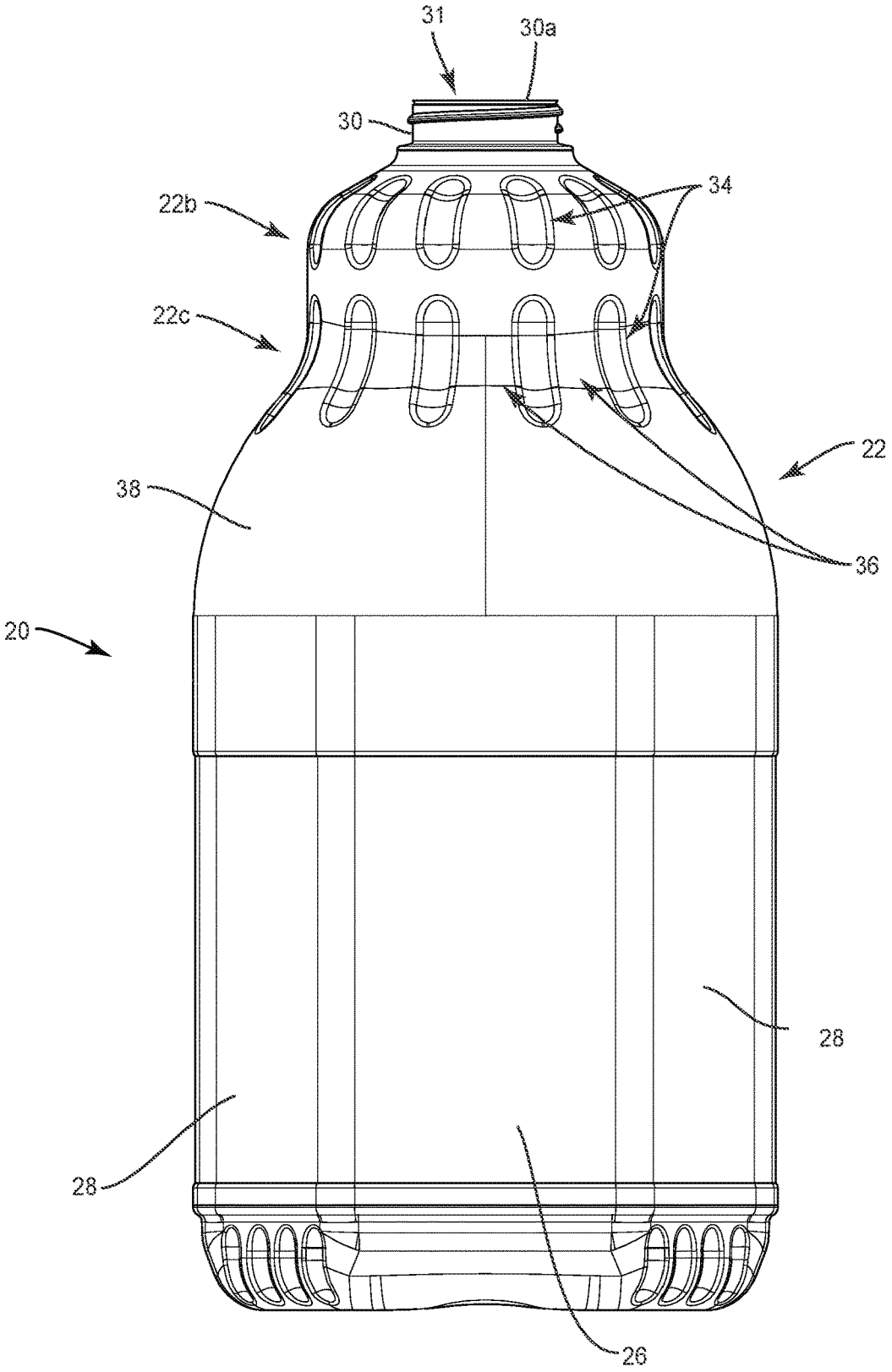
FIG. 8 is a side view of the container shown in FIG. 7.
Figure 9:
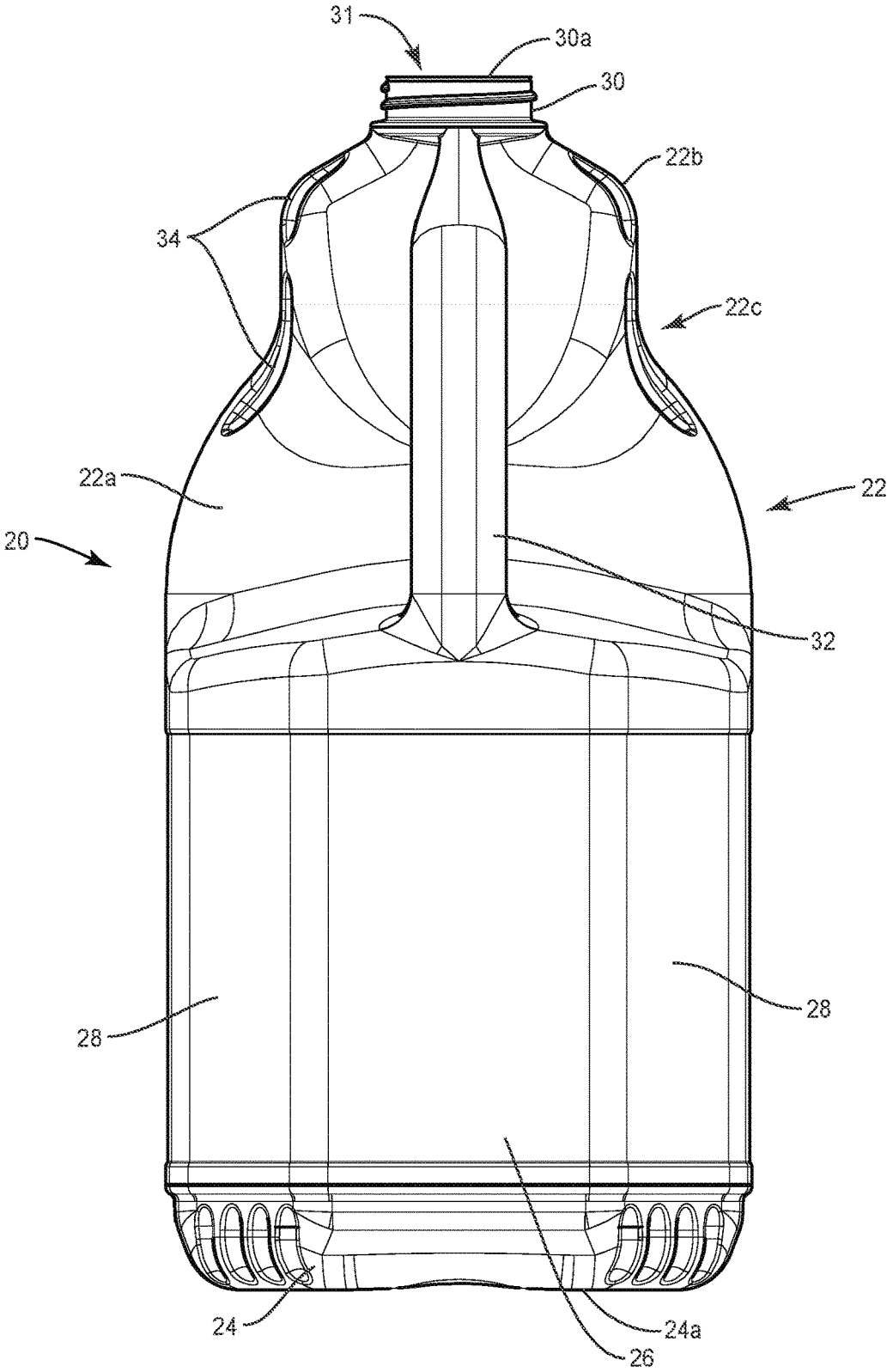
FIG. 9 is a side view of the container shown in FIG. 7.
Figure 10:
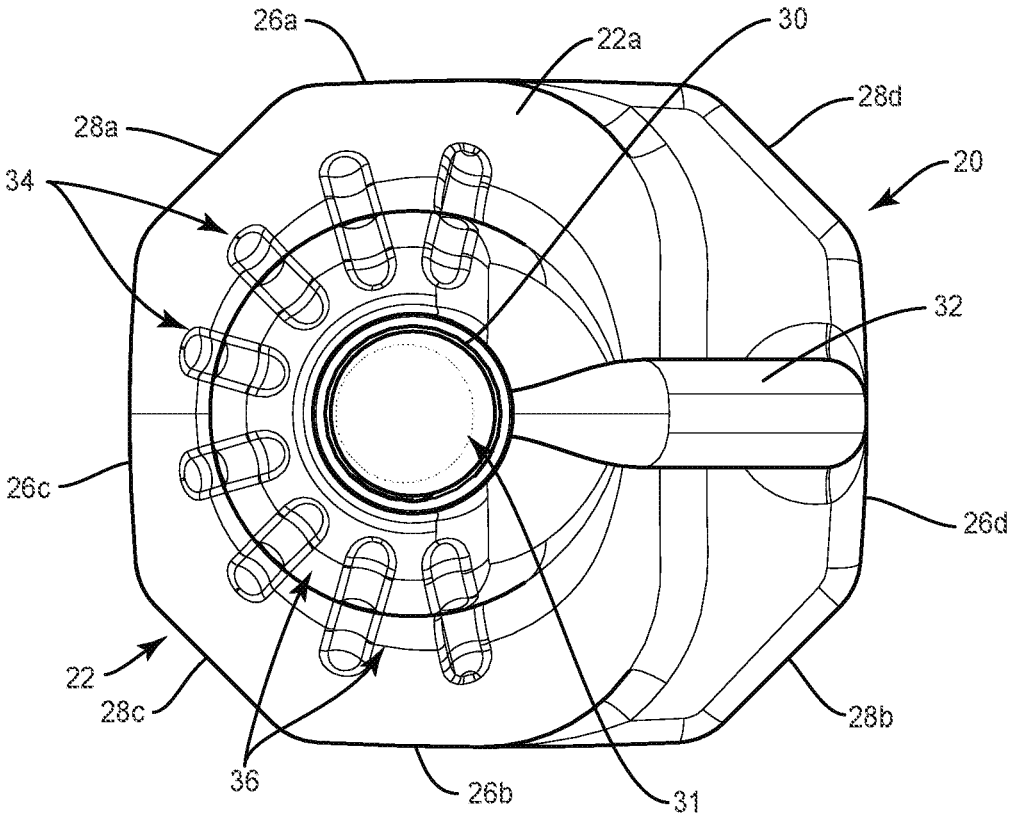
FIG. 10 is a top view of the container shown in FIG. 7.
Figure 11:
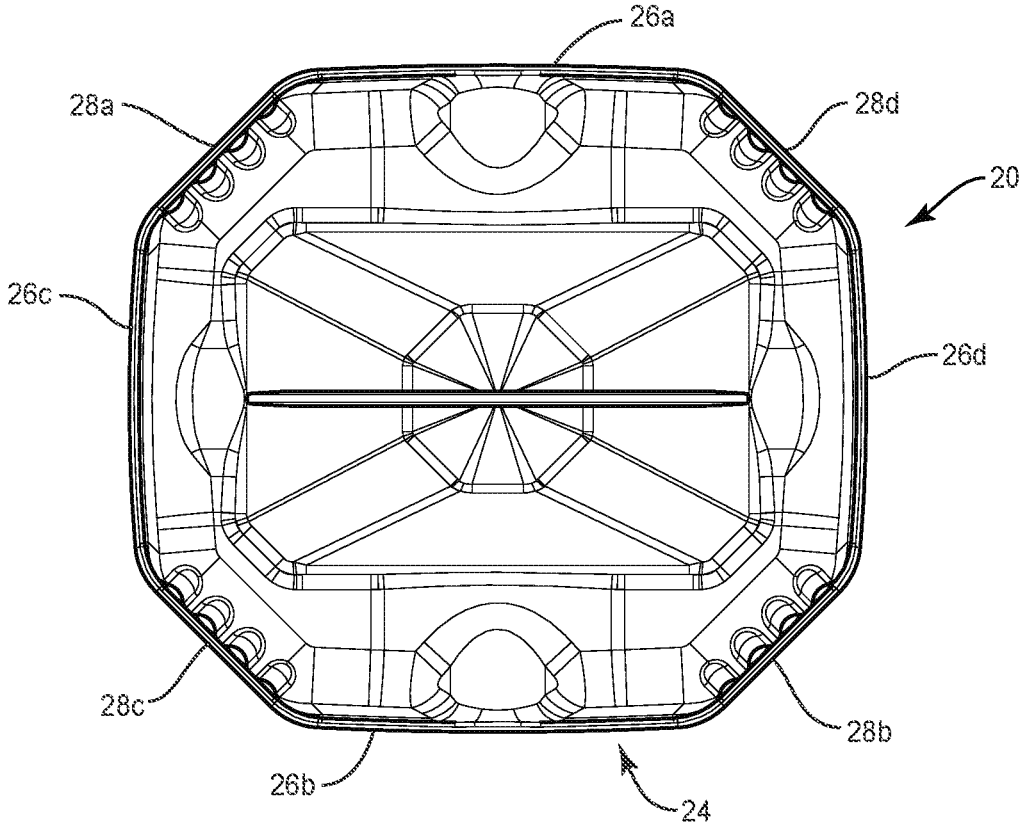
FIG. 11 is a bottom view of the container shown in FIG. 7.

Container 20 includes a top portion 22, a bottom portion 24, a plurality of sidewalls 26 and a plurality of sidewalls 28. Sidewalls 26, 28 each extend from an upper limit of bottom portion 24 and top portion 22 extends from upper limits of sidewalls 26, 28. Sidewalls 26, 28 are positioned between top portion 22 and bottom portion 24 and connect top portion 22 with bottom portion 24. Sidewalls 26 each have a width that is greater than that of sidewalls 28. In some embodiments, container 20 includes four sidewalls 26 and four sidewalls 28. A first pair of sidewalls 26*a*, 26*b* face one another and a second pair of sidewalls 26*c*, 26*d* face one another, as shown in FIGS. 4 and 5. A first pair of sidewalls 28*a*, 28*b* face one another and a second pair of sidewalls 28*c*, 28*d* face one another, as also shown in FIGS. 4 and 5. Sidewalls 26 are each positioned between two sidewalls 28 and sidewalls 28 are each positioned between two sidewalls 26, such that sidewalls 26, 28 provide container with an octagonal cross sectional configuration, as shown in FIGS. 4 and 5. In particular, sidewall 28*a* is positioned between sidewall 26*a* and sidewall 26*c*; sidewall 28*b* is positioned between sidewall 26*b* and sidewall 26*d*; sidewall 28*c* is positioned between sidewall is positioned between sidewall 26*c* and sidewall 26*b*; and sidewall 28*d* is positioned between sidewall 26*d* and sidewall 26*a*. In some embodiments, container 20 may have various cross section configurations, such as, for example, oval, oblong, triangular, rectangular, square, hexagonal, decagonal, polygonal, irregular, uniform, non-uniform, variable, tubular and/or tapered.

Top portion 22 includes a body portion 22*a* having a spout 30 with an opening 31 by which material may be introduced into the interior of container 20. Body portion 22*a* defines a shoulder portion of container 20. Container 20 includes a handle 32 which is hollow and permits liquid and air to pass inside it. Handle 32 extends from one of sidewalls 26, such as, for example, sidewall 26*d* to spout 30, so that when container 20 is held for pouring, the center of mass is concentrated along the axis which intersects both handle 32 and sidewall 26*d*. That is, a first end of handle 32 directly engages a portion of spout 30 and a second end of handle 32 directly engages a portion of sidewall 26*d*. In some embodiments, container 20 includes a bridge 32*a* that joins handle 32 with body portion 22*a* of top section, as shown in FIG. 1. Bridge 32*a* provides added strength to handle 32. In some embodiments, container 20 includes one or a plurality of bridges 32*a*. In some embodiments, bridge 32*a* is positioned adjacent spout 30, as shown in FIG. 1. However, it is envisioned that bridges 32*a* may be positioned along any portion of handle 32 between handle 32 and body portion 22*a* of top portion 22.

The height of container 20 is measured from a bottom surface 24*a* of bottom portion 24 to a top surface 30*a* of spout 30. In some embodiments, the height of container is approximately 11.5 inches, for a container having a volume of approximately 128 ounces or 234 cubic inches (e.g., a one-gallon container). Container 20 has a weight between 70 grams and 80 grams or between about 70 grams and about 80 grams, which is less than the weight of conventional one-gallon containers (110 grams). In some embodiments, container 20 is blow-molded, and includes a single piece thin wall construction. In some embodiments, container 20 is injection molded. In some embodiments, as shown in FIGS. 1-6, container 20 has a weight of about 80 grams and has an average wall thickness of 0.018 inches. In some embodiments, as shown in FIGS. 7-11, container 20 has a weight of about 75 grams or about 80 grams and has an average wall thickness of 0.018 inches.

To avoid complications, such as, for example, top load failure caused by the thin wall construction of container 20, body portion 22*a* of top portion 22 includes one or a plurality of depressions or dimples, such as, for example, indents 34. Indents 34 each have a rectangular or substantially rectangular configuration, as best shown in FIG. 4. In some embodiments, indents 34 are variously shaped, such as, for example, circular, oval, triangular, square, polygonal, irregular, uniform, non-uniform, offset, staggered, undulating, arcuate, variable and/or tapered.

Figure 2:
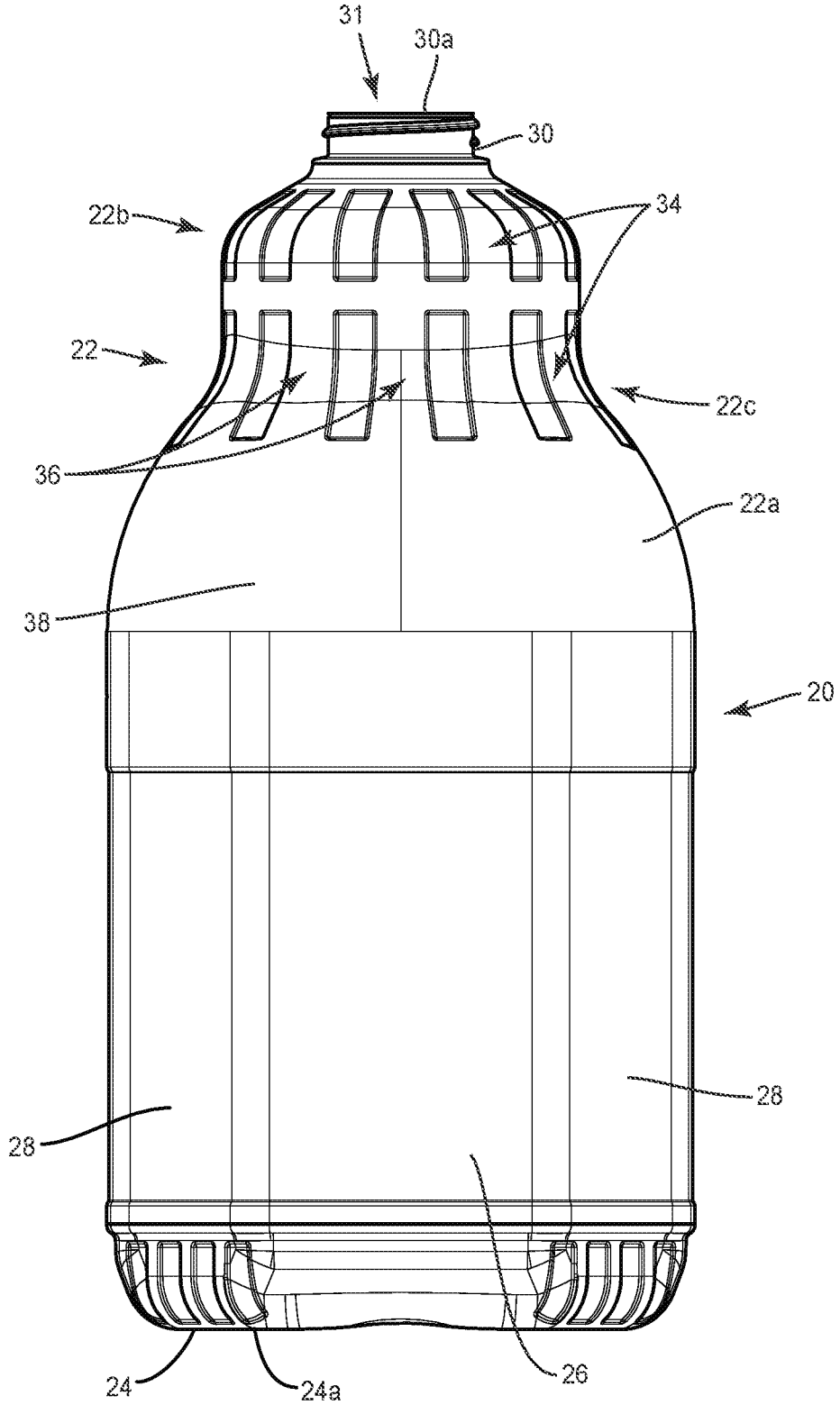
FIG. 2 is a side view of the container shown in FIG. 1.

Indents 34 are arranged in a configuration to provide strength to container 20 that makes container 20 stronger than containers made from HDPE having the same average wall thickness, but do not include indents 34 and/or the configuration of indents shown in FIGS. 1-5. This configuration includes a plurality of spaced apart columns of indents 34, wherein each column comprises at least two indents that are spaced apart from one another such that body portion 22*a* of top portion 22 includes at least two rows of indents 34. Adjacent columns of indents 34 form ribs 36 therebetween. Body portion 22*a* comprises a section 38 between the lower limits of indents 34 and/or ribs 36 and the upper limits of sidewalls 26, 28 that has a smooth outer surface, as shown in FIG. 2. That is, section 38 is free of indents 34 and ribs 36.

Figure 3:
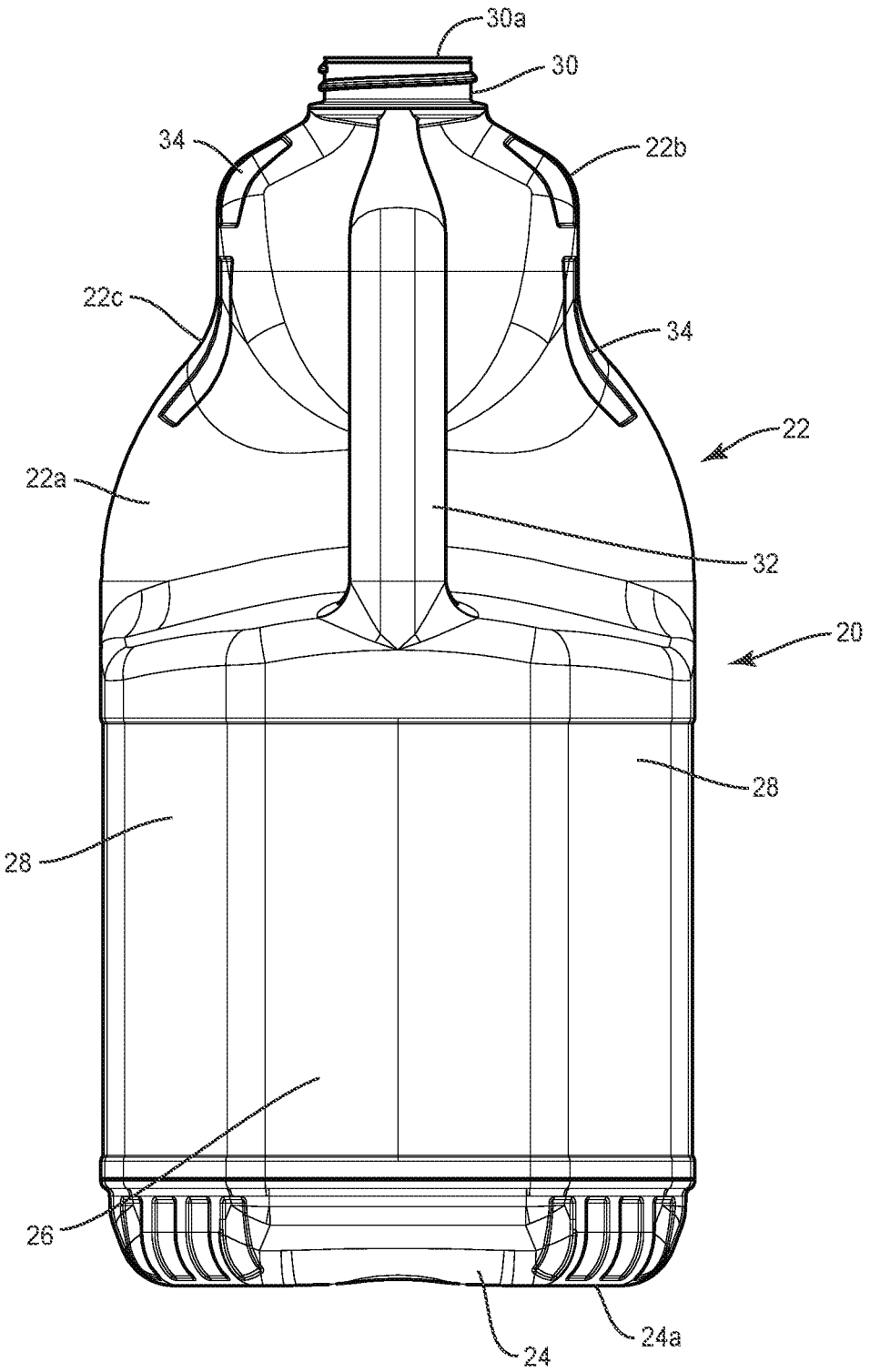
FIG. 3 is a side view of the container shown in FIG. 1.

In some embodiments, indent(s) 34 in each of the columns is/are coaxial with the indent(s) in the same column. That is, indent(s) 34 in each of the columns is/are aligned along a straight line with the indent(s) in the same column. In some embodiments, a first row of indents 34 extends across in a first arcuate section 22*b* of body portion 22*a* and a second row of indents 34 extends across a second arcuate section 22*c* of body portion 22*a*, as best shown in FIG. 2. In some embodiments, first arcuate portion 22*b* is convexly curved and second arcuate portion 22*c* is concavely curved. Indents 34 are spaced apart from handle 32, as shown in FIG. 3, for example. In some embodiments, container 20 comprises eight columns of indents 34, wherein each column comprises two indents 34 that are spaced apart from one another such that body portion 22*a* has two rows of spaced apart indents 34. In some embodiments, each of indents 34 in the first row of indents 34 that extend across first arcuate portion 22*b* are positioned radially about spout 30, as shown in FIG. 4, for example. That is, each of indents 34 in the first row of indents 34 extends at an acute angle relative to an adjacent one of indents 34 in the first row of indents 34. In some embodiments, the acute angle between adjacent indents 34 is the same for all indents 34 in the first row of indents. This configuration of indents 34 causes ribs 36 to be tapered. That is, ribs 36 each have a maximum width adjacent to spout 30 that is less than a maximum width of ribs 36 adjacent the upper limits of sidewalls 26, 28.

Turning now to FIGS. 7-11 container 20 may include indents 34 having an oblong shape. In some embodiments, the indents 34 having the oblong shape have the same depth as the indents 34 having the rectangular shape. However, it is envisioned that the indents 34 having the oblong shape may be deeper than the indents 34 having the rectangular shape. It is also envisioned that the indents 34 having the oblong shape may be shallower than the indents 34 having the rectangular shape. In some embodiments, the depth of indents 34 is directly proportional to the thickness of ribs 36. Indeed, the deeper indents 34 are, the thicker ribs 36 are. It is contemplated that thicker ribs 36 may provide added strength to container 20. That is, the thicker ribs 36 are, the stronger it makes container 20. As such, one of ordinary skill in the art could adjust the thickness of indents 34 and/or ribs 36 by altering the depths of indents in container 20 shown in FIGS. 1-6 and container 20 shown in FIGS. 7-11, depending upon strength requirements for container 20.

In some embodiments, indents 34 having the oblong shape are the same length the indents 34 having the rectangular shape. However, it is envisioned that indents 34 having the oblong shape may be longer than indents 34 having the rectangular shape. It is also envisioned that indents 34 having the oblong shape may be shorter than the indents 34 having the rectangular shape.

Figure 12:
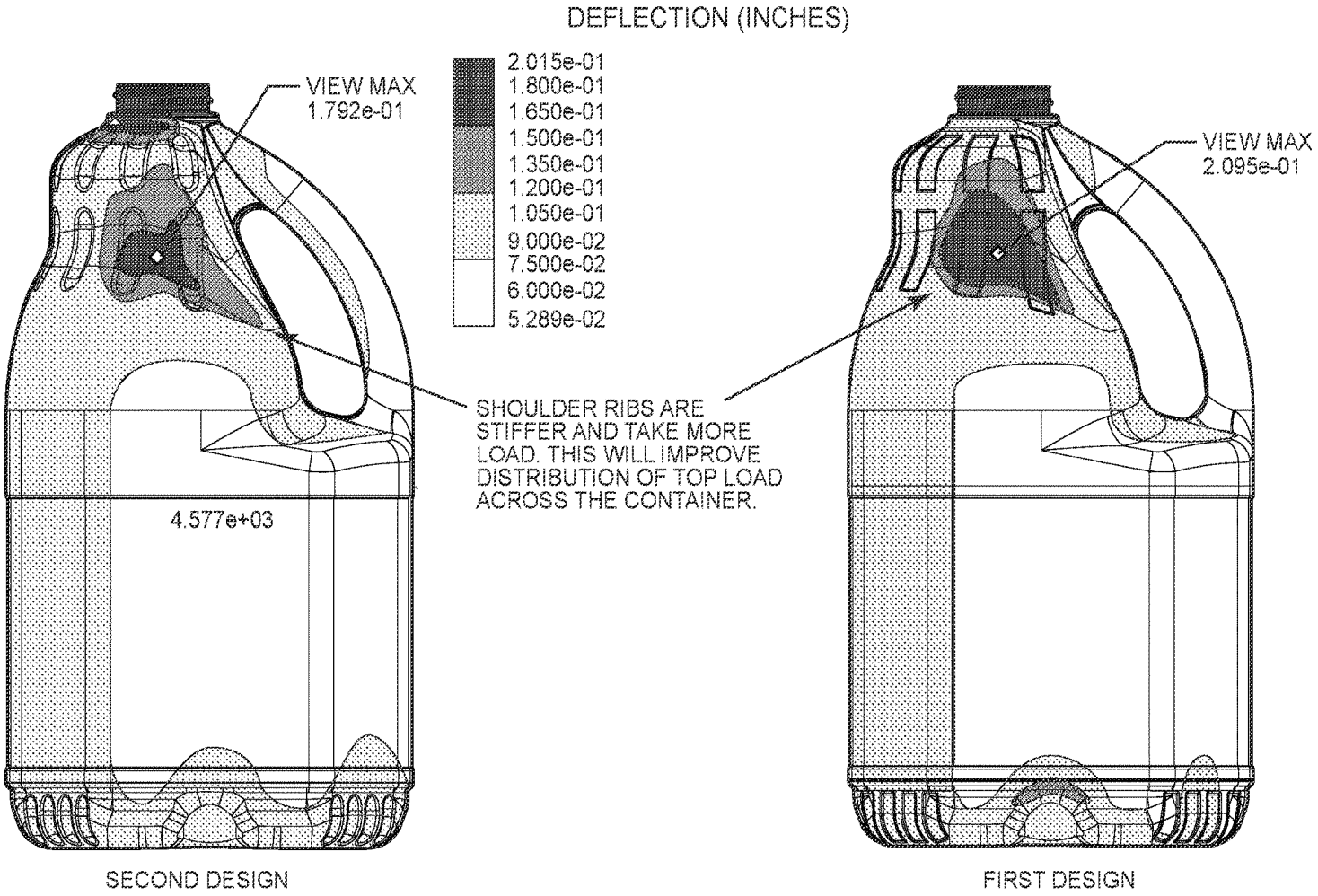
FIG. 12 is a side view of the containers shown in FIGS. 1 and 7.

It has been found that the shape of indents 34 may have an effect on the performance characteristics of container 20. For example, testing has shown that container 20 shown in FIGS. 1-6 with rectangular indents 34 has different performance characteristics than container 20 shown in FIGS. 7-11 with oblong indents 34, when the indents 34 having the oblong shape have the same depth and length as the indents 34 having the rectangular shape. For example, during a test in which 40 lbf. top load was applied on spout 30 in the container 20 shown in FIGS. 1-6 and the container 20 shown in FIGS. 7-11, deflection in body portion 22*a* of top portion 22, such as, for example, second arcuate portion 22*b* is reduced in the container 20 shown in FIGS. 7-11 relative to the container 20 shown in FIGS. 1-6, as shown in FIG. 12. In some embodiments, deflection in body portion 22*a* of top portion 22, such as, for example, second arcuate portion 22*b* is reduced in the container 20 shown in FIGS. 7-11 relative to the container 20 shown in FIGS. 1-6 by 10%. It is noted that the container 20 shown in FIGS. 1-6 is sometimes referred to as "the first design" in FIGS. 12-16 and the container 20 shown in FIGS. 7-11 is sometimes referred to as "the second design" in FIGS. 12-16.

Figure 13:
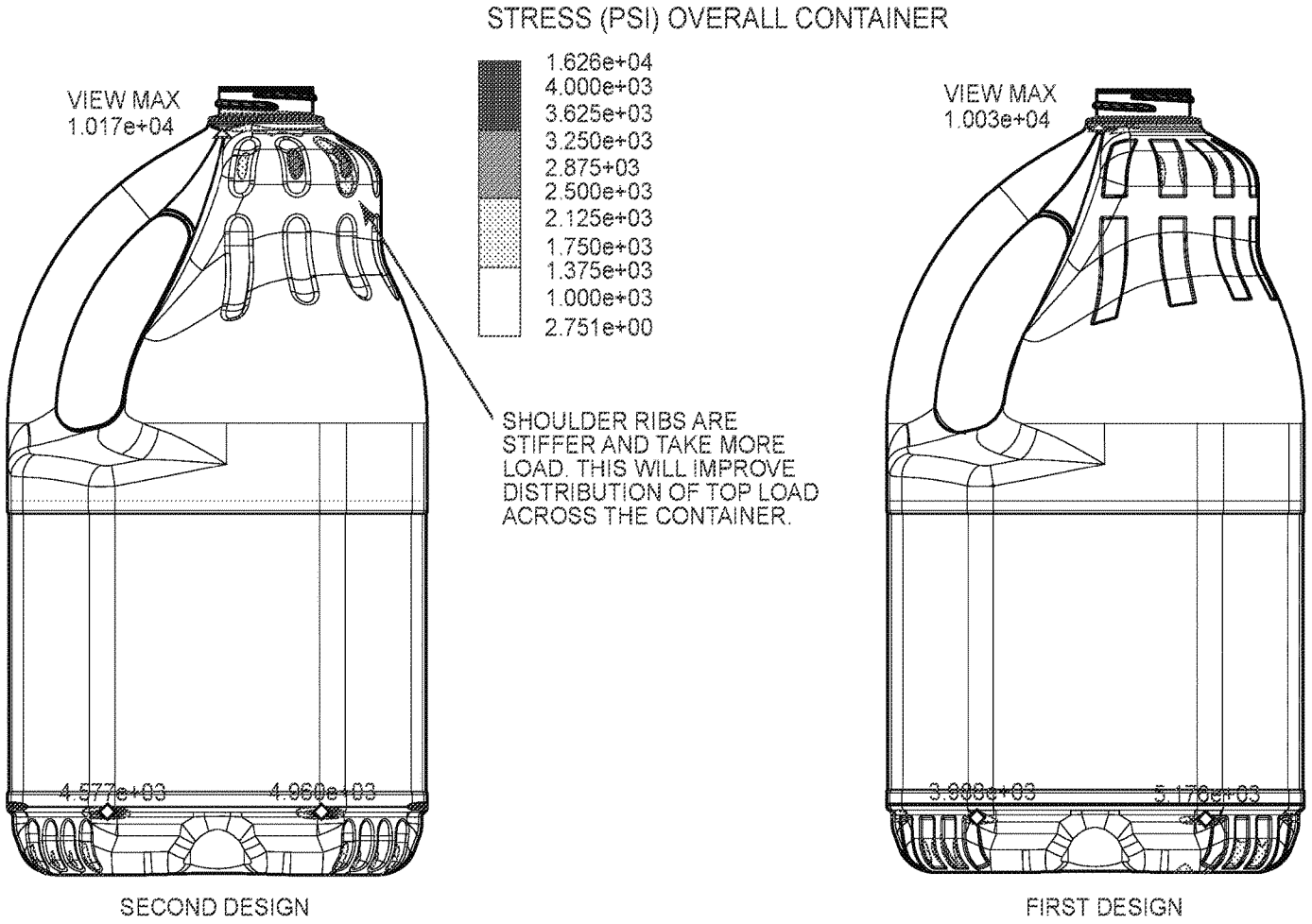
FIG. 13 is a side view of the containers shown in FIGS. 1 and 7.

The test discussed above also has demonstrated that the overall stress on the container 20 shown in FIGS. 7-11 is less relative to the container 20 shown in FIGS. 1-6, as shown in FIG. 13. It is envisioned that reduction in overall stress in the container 20 shown in FIGS. 7-11 may be due, at least in part, to stiffer ribs 36, which may improve distribution of top load across the container 20.

Figure 14:
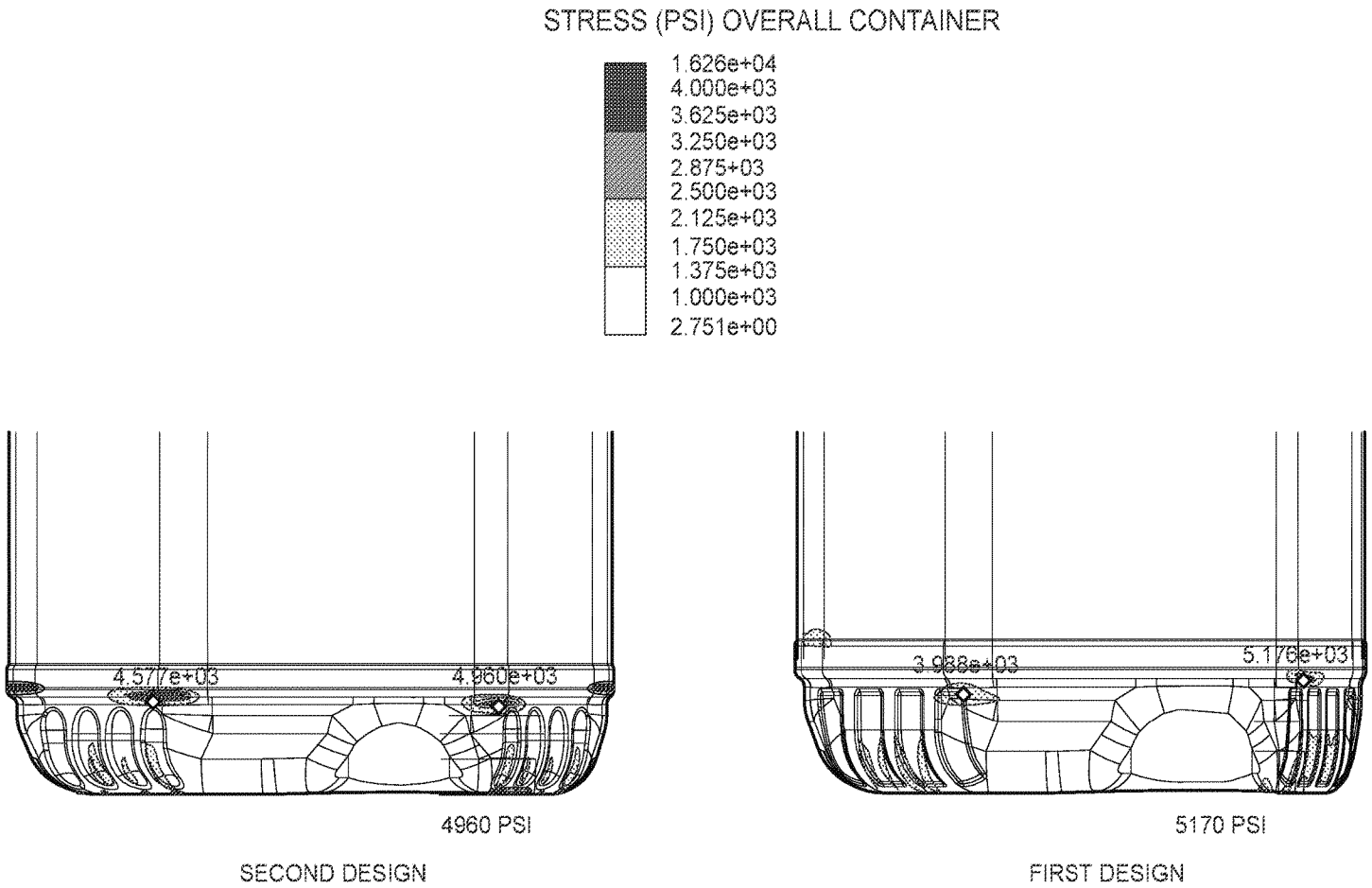
FIG. 14 is a detailed side view of a portion of each of the containers shown in FIGS. 1 and 7.
Figure 15:
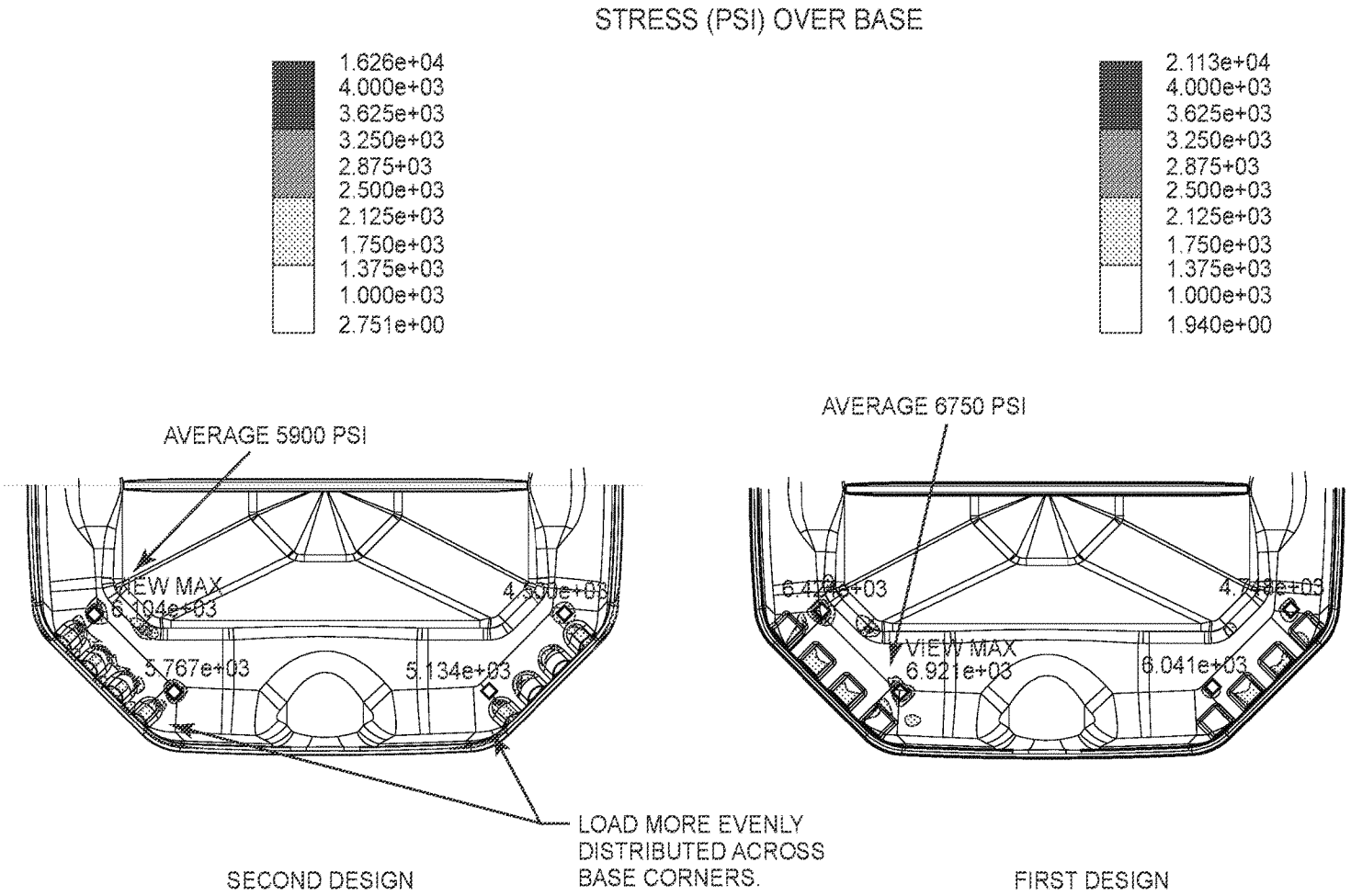
FIG. 15 is a detailed bottom view of a portion of each of the containers shown in FIGS. 1 and 7.
Figure 16:
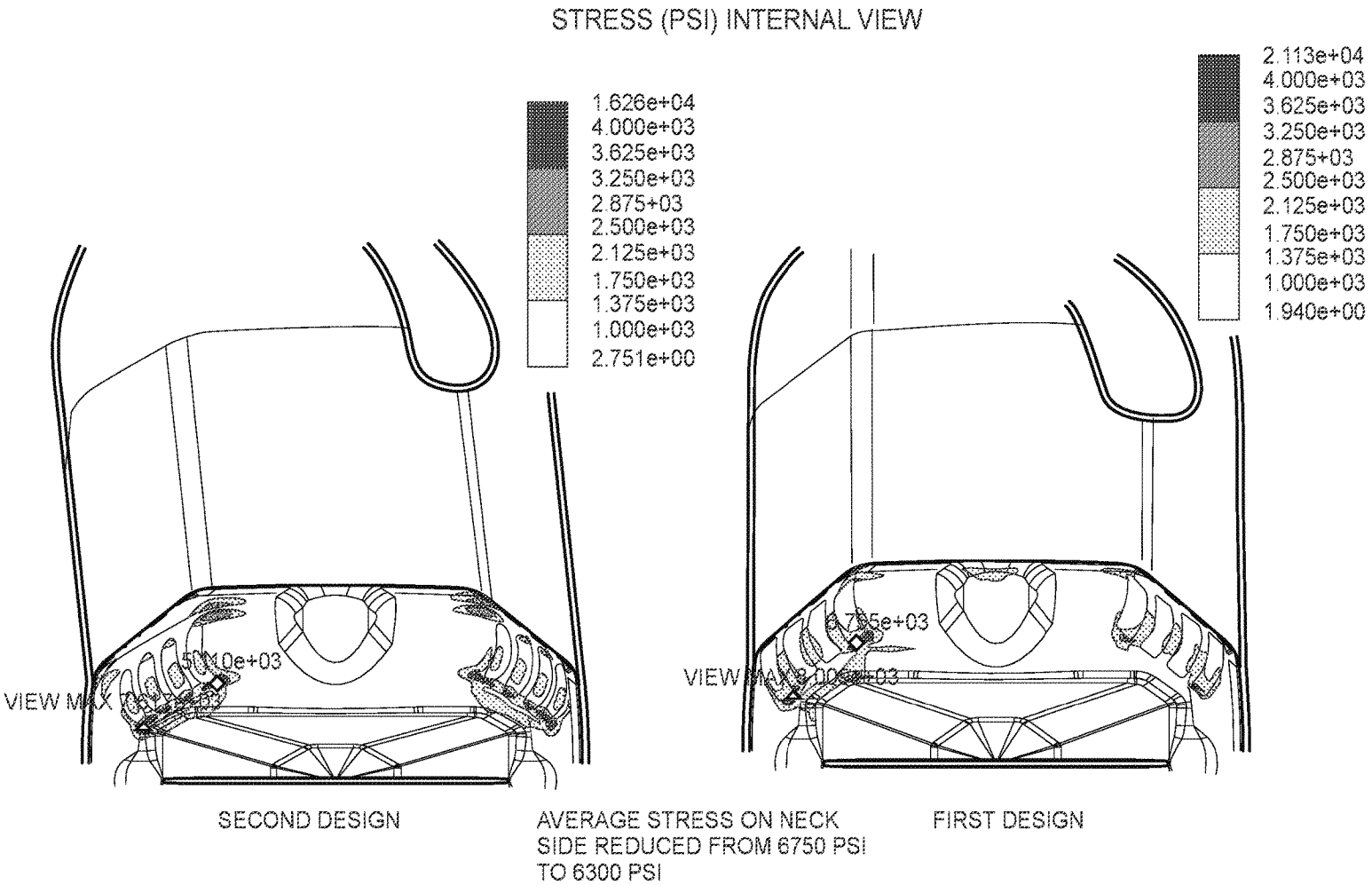
FIG. 16 is a detailed bottom perspective view of a portion of each of the containers shown in FIGS. 1 and 7.

The shape of indents 34 may have an effect on the performance characteristics of other portions of container 20 as well. For example, during the test in which 40 lbf. top load was applied on spout 30 in the container 20 shown in FIGS. 1-6 and the container 20 shown in FIGS. 7-11, stress on corners of bottom portion 24 is reduced in the container 20 shown in FIGS. 7-11 relative to the container 20 shown in FIGS. 1-6, as shown in FIG. 14. In some embodiments, the stress on corners of bottom portion 24 is reduced from 5170 psi to 4960 psi and/or by 5-7%. Furthermore, stress over bottom portion 24 is reduced in the container 20 shown in FIGS. 7-11 relative to the container 20 shown in FIGS. 1-6, as shown in FIGS. 15 and 16. In some embodiments, the average stress over bottom portion 24 is reduced from 6750 psi to 5900 psi.

Due to the increased strength of the container 20 shown in FIGS. 7-11 relative to the container 20 shown in FIGS. 1-6, it has been determined that the container 20 shown in FIGS. 7-11 may be made with less HDPE than the container 20 shown in FIGS. 1-6. For example, since the container 20 shown in FIGS. 7-11 will have better top load than the container 20 shown in FIGS. 7-11, when both containers are the same weight (e.g., 80 grams), it has been found that the container 20 shown in FIGS. 7-11 may be reduced in weight to 75 grams and still have the same top load as the container 20 shown in FIGS. 1-6 weighing 80 grams.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A container comprising:

a top portion;

a bottom portion; and a plurality of sidewalls that each extend from an upper limit of the bottom portion, the top portion extending from upper limits of each of the side walls such that the sidewalls are positioned between the top portion and the bottom portion, wherein the top portion comprises a plurality of first indents and a plurality of second indents therein to avoid top load failure, the first indents defining a first row and the second indents defining a second row, the first indents being spaced apart from the second indents, and wherein the first row extends across a convexly curved section of the top portion and the second row extends across a concavely curved section of the top portion, the concavely curved section having a maximum diameter greater than a maximum diameter of the convexly curved section, the first row extending across a portion of the convexly curved section that defines the maximum diameter of the convexly curved section, the first row being spaced apart from the concavely curved section.

2. A container as recited in claim 1, wherein the indents each have a rectangular configuration.

3. A container as recited in claim 1, wherein the indents each have an oblong configuration.

4. A container as recited in claim 1, wherein the indents are arranged in a configuration to provide strength to the container that makes the container stronger than containers that are made from the same material and have the same weight and the same average wall thickness, but do not include indents.

5. A container as recited in claim 1, wherein the second row is positioned below the first row, the rows defining a plurality of spaced apart columns, each of the columns comprising at least one of the first indents and at least one of the second indents that are spaced apart from one another.

6. A container as recited in claim 5, wherein adjacent columns each form a rib therebetween.

7. A container as recited in claim 5, wherein the indent(s) in each of the columns is/are coaxial with the indent(s) in the same column.

8. A container as recited in claim 5, wherein the indent(s) in each of the columns is/are aligned along a straight line with the indent(s) in the same column.

9. A container as recited in claim 1, wherein the container has a thin wall construction.

10. A container as recited in claim 1, wherein the container has an average wall thickness of about 0.018 inches.

11. A container as recited in claim 1, wherein the container has a weight of 70 to 80 grams and a volume of 128 ounces.

12. A container as recited in claim 1, wherein the container has a weight of 75 grams and a volume of 128 ounces.

13. A container as recited in claim 1, wherein the container has a weight of 80 grams and a volume of 128 ounces.

14. A container as recited in claim 1, wherein the container is made from high density polyethylene (HDPE).

15. A container as recited in claim 1, wherein the container is a blow-molded container.

16. A container as recited in claim 1, wherein the plurality of sidewalls comprises eight sidewalls.

17. A container as recited in claim 1, wherein the top portion includes a body portion having a spout with an opening by which material may be introduced into the interior of the container, the indents being positioned radially about the spout such that each of the first indents extends at an acute angle relative to an adjacent one of the first indents and each of the second indents extends at an acute angle relative to an adjacent one of the second indents.

18. A container as recited in claim 17, wherein the body portion defines a shoulder portion of the container.

19. A container as recited in claim 1, wherein the container includes a handle which is hollow and permits liquid and air to pass inside it.

20. A container as recited in claim 19, wherein the handle extends from one of the sidewalls to a spout in the top portion.

21. A container as recited in claim 19, wherein the handle is positioned such that when the container is held for pouring, a center of mass is concentrated along an axis which intersects both the handle the sidewall the handle extends from.

22. A container as recited in claim 19, wherein a first end of the handle directly engages a portion of the spout and a second end of the handle directly engages a portion of the sidewall the handle extends from.

23. A blow-molded container comprising:

a top portion comprising a spout;

a bottom portion; and a plurality of sidewalls that each extend from an upper limit of the bottom portion, the top portion extending from upper limits of each of the side walls such that the sidewalls are positioned between the top portion and the bottom portion, wherein the container is made from high density polyethylene, wherein the top portion comprises a row of first indents therein, the first indents each having an oblong configuration, the first indents being positioned radially about the spout such that each of the first indents extends at an acute angle relative to an adjacent one of the first indents, wherein the first indents are arranged in a configuration to provide strength to the container that makes the container stronger than containers that are made from the same material and have the same average wall thickness, but do not include indents, wherein the top portion includes a row of second indents positioned below the row of first indents, the first indents being spaced apart from one another and the second indents, the second indents being spaced apart from one another, the rows defining columns that include at least one of the first indents and at least one of the second indents, wherein the row of first indents extends across a convexly curved section of the top portion and the row of second indents extends across a concavely curved section of the top portion, the concavely curved section having a maximum diameter greater than a maximum diameter of the convexly curved section, the row of first indents extending across a portion of the convexly curved section that defines the maximum diameter of the convexly curved section, the first row of indents being spaced apart from the concavely curved section, wherein the container has an average wall thickness of about 0.018 inches, wherein the container has a weight of 70 to 80 grams and a volume of 128 ounces.

24. A container comprising a plurality of first indents and a plurality of second indents therein to avoid top load failure, the first indents defining a first row and the second indents defining a second row, the first indents being spaced apart from the second indents, and wherein the first row extends across a convexly curved section of the container and the second row extends across a concavely curved section of the container, the concavely curved section having a maximum diameter greater than a maximum diameter of the convexly curved section, the first row extending across a portion of the convexly curved section that defines the maximum diameter of the convexly curved section, the first row being spaced apart from the concavely curved section.

25. A container as recited in claim 24, wherein the second row is positioned below the first row, the rows defining a plurality of spaced apart columns, each of the columns comprising at least one of the first indents and at least one of the second indents that are spaced apart from one another.

* * * * *